US009551535B2

(12) United States Patent
Rodrick

(10) Patent No.: US 9,551,535 B2
(45) **Date of Patent: *Jan. 24, 2017**

(54) APPARATUS AND METHOD FOR COOLING SELECTED PORTIONS OF SWIMMING POOL WATER

(71) Applicant: Robert M Rodrick, Lebanon, NJ (US)

(72) Inventor: Robert M Rodrick, Lebanon, NJ (US)

(73) Assignees: Robert M. Rodrick, Lebanon, NJ (US); Jonathan R. Rodrick, Port Murray, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/172,177

(22) Filed: Jun. 3, 2016

(65) Prior Publication Data

US 2016/0348981 A1 Dec. 1, 2016

Related U.S. Application Data

(63) Continuation-in-part of application No. 14/576,345, filed on Dec. 19, 2014, now Pat. No. 9,366,046.

(51) Int. Cl.

| | |
|---|---|
| ***E04H 4/00*** | (2006.01) |
| ***F28D 1/047*** | (2006.01) |
| ***E04H 4/12*** | (2006.01) |
| ***E04H 4/14*** | (2006.01) |

(52) U.S. Cl.
CPC ..... *F28D 1/0477* (2013.01); *E04H 4/1245* (2013.01); *E04H 4/14* (2013.01)

(58) Field of Classification Search
CPC ..... F28D 1/0477; E04H 4/1245; E04H 4/14; F24F 5/0046
USPC ..... 4/493, 488, 509
See application file for complete search history.

(56) References Cited

U.S. PATENT DOCUMENTS

| | | | | |
|---|---|---|---|---|
| 2,749,724 | A | 6/1956 | Borgerd et al. | |
| 3,399,540 | A * | 9/1968 | Kahmann | E04H 4/129 62/201 |
| 3,970,069 | A | 7/1976 | Pickett | |
| 4,153,955 | A | 5/1979 | Hinterberger | |
| 4,189,791 | A | 2/1980 | Dundas | |
| 4,211,213 | A | 7/1980 | Nissen et al. | |
| 4,250,957 | A | 2/1981 | McClendon | |

(Continued)

FOREIGN PATENT DOCUMENTS

JP 57169553 A2 10/1982

*Primary Examiner* — Christine Skubinna
(74) *Attorney, Agent, or Firm* — Robert M. Rodrick

(57) ABSTRACT

An apparatus and method for cooling water in a swimming pool includes a heat exchanger coupled to a withdrawal conduit and a skimmer conduit of the pool filtering system. The heat exchanger is buried in the ground at a depth at which the ground temperature is substantially constant year-round thereby providing a passive heat sink for the heat exchanger. Water from the swimming pool is passed to a three-way valve for directing pool water either directly back to the swimming pool or through the heat exchanger for cooling pool water by heat transfer to the ground heat sink before being returned to the pool. Pool water from the skimmer conduit is selectively directed through the heat exchange while flow of pool water from the withdrawal conduit is prevented. A temperature sensor may control operation of the three-way valve and selective operation of the skimmer and withdrawal conduits.

20 Claims, 2 Drawing Sheets

(56) References Cited

U.S. PATENT DOCUMENTS

| | | | |
|---|---|---|---|
| 4,381,763 | A | 5/1983 | Kahl |
| 4,421,643 | A | 12/1983 | Frederick |
| 4,616,487 | A | 10/1986 | Franklin |
| 5,152,153 | A | 10/1992 | Hsiao |
| 6,122,922 | A | 9/2000 | Conner |
| 6,138,294 | A | 10/2000 | Desjoyaux et al. |
| 7,624,589 | B1 | 12/2009 | Argovitz |
| 8,820,394 | B2 | 9/2014 | Azzam |
| 2001/0029625 | A1 | 10/2001 | Lynn |
| 2001/0047539 | A1 | 12/2001 | Lynn |
| 2008/0016894 | A1 | 1/2008 | Wiggs |
| 2010/0155040 | A1 | 6/2010 | Hoffmann et al. |
| 2012/0145251 | A1* | 6/2012 | Robol ..... E04H 4/1245 137/14 |
| 2013/0227974 | A1 | 9/2013 | Kirks |
| 2013/0327316 | A1 | 12/2013 | Bourgeois et al. |
| 2014/0123381 | A1 | 5/2014 | Stephens |

* cited by examiner

APPARATUS AND METHOD FOR COOLING SELECTED PORTIONS OF SWIMMING POOL WATER

CROSS-REFERENCES TO RELATED APPLICATIONS

This is a continuation-in-part application of U.S. application Ser. No. 14/576,345, filed Dec. 19, 2014, now U.S. Pat. No. 9,366,046, which issued on Jun. 14, 2016, and which is herein incorporated by reference in its entirety.

FIELD OF THE INVENTION

The subject invention relates generally to the field of swimming pools and more particularly to an apparatus and method for cooling water in a swimming pool.

BACKGROUND OF THE INVENTION

Swimming pools are enjoyed by many as a way of cooling off on hot summer days. The desired temperature of the swimming pool water for most comfortable enjoyment is in the range of about 70° F. to about 80° F. (approximately 21° C. to 27° C.). As such, controlling the water temperature to the comfort range is desirable. In cooler climates where the air temperature is typically lower, especially at night, heating the pool water with solar and other systems is well known. Such heating systems allow extended use of the swimming pool even when the temperature drops below 70° F. (21° C.).

In warmer climates, such as in the Southern United States, the ambient temperature can reach 100° F. (38° C.), or more, in the summer months. Swimming pool water in such conditions, particularly where there is no shade from the sun, can reach an uncomfortable 90° F. (32° C.), or higher, even with inground pools. Inground pools are commonly dug into the ground to depths of 8-10 feet or more to accommodate diving at the deeper portions of the pool. It is known that the temperature of the ground at a depth beginning at about five feet below ground level is substantially constant year-round, as recognized by many, including McClendon in U.S. Pat. No. 4,250,957, issued on Feb. 17, 1981. This constant temperature is in the range of approximately 55° F.-65° F. (approximately 13° C.-18° C.), depending upon the location, as noted by Azzam in U.S. Pat. No. 8,820,394, issued on Sep. 2, 2014.

While the bottom of inground pools at 8-10 feet is lower than the depth of about five feet at which the ground temperature is constant at around 55° F. (13° C.), the construction of the walls of the pool basin typically inhibits use of the lower ground temperature as a source of cooling for the swimming pool. Walls of inground pools are commonly constructed of concrete, such as Gunite material, or fiberglass, both of which are poor conductors of heat. Basin walls made of these materials thereby introduce a thermal barrier between the pool water and the ground which serves to insulate the pool water from the surrounding cool temperature of the ground. Further, manufactures often use an additional layer of insulation such as vinyl, either to the inner surface of the basin wall to keep heat in the pool water, or to the outside of the basin wall to keep the cold of the ground out. Sometimes, both inside and outside layers are used.

Certain efforts have been made to provide systems for cooling swimming pool water. One example is described by Argovitz in U.S. Pat. No. 7,624,589, issued on Dec. 1, 2009.

The Argovitz apparatus comprises a cooler including a hollow tower that uses evaporative cooling principles to cool swimming pool water. Argovitz describes a number of other efforts that have been made to cool swimming pool water, which he indicates as being too costly or too complicated or cumbersome to install. Accordingly, there is interest in providing an improved system or apparatus that can effectively and inexpensively cool water in a swimming pool for the comfort of swimmers during hot weather conditions.

SUMMARY OF THE INVENTION

It is an object of the invention to provide an apparatus for cooling water in a swimming pool.

It is a further object of the invention to provide a method of cooling water in a pool by directing water from selected portions of the pool through a heat exchanger buried in the ground.

DESCRIPTION OF THE EMBODIMENTS

Figure 1:
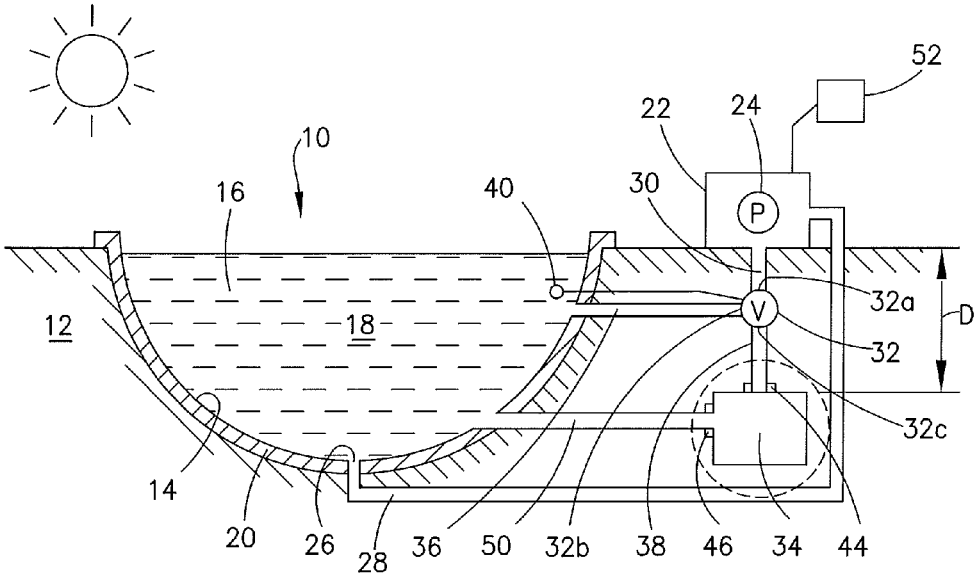
FIG. 1 is a schematic representation of a swimming pool with a filtering system in combination with an apparatus of the invention including a heat exchanger buried below ground for cooling water from the pool.

For the purposes of promoting an understanding of the principles of the invention, reference will now be made to the drawing figures and the following written description. It is understood that no limitation to the scope of the invention is thereby intend. It is further understood that the present invention includes any alterations and modifications to the illustrated arrangements and further includes applications of principles of the invention as would normally occur one skilled in the art to which this invention pertains.

Referring now to FIG. 1, an inground swimming pool 10 is shown in accordance with one arrangement of the invention. Swimming pool 10 may be dug into the ground 12 at a depth of 8 to 10 feet or more in order to allow at least a portion of the pool 10 to be used for diving. Pool 10 includes a basin 14 defining an interior volume 16 for holding swimming pool water 18, which may be up to 25,000 gallons, or more.

Basin 14 includes a wall 20 that may be may be formed of concrete, such as a Gunite material, for structurally containing water 18 within basin 14. While concrete provides flexibility for pool design and structural integrity, the thermal conductivity of concrete is typically very low. Thermal conductivity is defined as the property of a material to conduct heat, and is commonly expressed in the International System of Units (SI) as watts per meter Kelvin (W/mK). The thermal conductivity of concrete ranges from about 0.1 W/mK for lightweight concrete to about 1.8 W/mK for more dense concrete. As such, pool basin 14 formed of a wall 20 of concrete effectively establishes a thermal barrier between pool water 18 and ground 12. It should be appreciated that basin 14 may be also formed to have a wall of other suitable materials, such as fiberglass.

Fiberglass also has a low thermal conductivity of about 0.04 W/mK, which would thereby also establish a thermal barrier between pool water 18 and ground 12. In addition, pool liners such as vinyl may also be used either on the interior surface of basin 14 or the exterior surface of basin 14, or both, with such liners adding to the thermal resistance already provided by either a concrete or fiberglass wall 20.

Inground pool 10 comprises a filtering system 22 that includes a pump 24 for circulating pool water 18 to and from interior volume 16, as will be further described. Filtering system 22 and pump 24 may be of conventional commercially available systems which are typically used with inground pools for circulating pool water 18 through the filtering system 22 to keep pool water 18 clean as well as to add appropriate chemicals to pool water 18 during the circulation process. Pool water 18 is withdrawn from basin 14 through a drain 26 typically located at the bottom of basin 14. A withdrawal conduit 28 is placed in communication with drain 26 and with filtering system 22 such that pool water 18 can be withdrawn from interior volume 16 by pump 24 through withdrawal conduit 28 and into and through filtering system 22. Pool water 18 may also be withdrawn from interior volume 16 by surface skimmers (not shown) that may be placed at the surface level of pool water 18, with such skimmers being in communication with withdrawal conduit 28. Filtered water 18 is returned from filtering system 22 by pump 24 to interior volume 16 through a return conduit 30 in communication with filtering system 22.

In accordance with one arrangement of the invention, a valve 32 is placed in communication with return conduit 30 for selectively directing filtered water 18 either directly back to interior volume 16 or to a heat exchanger 34 for cooling such filtered water 18, as will be described. Valve 32 is in one arrangement a three-way valve having an input 32*a*, a first output 32*b* and a second output 32*c*. Valve 32 is capable of directing pool water 18 from the filtering system 22 in two directions and operable to select one of those two directions. First output 32*b* communicates directly with interior volume 16 through conduit section 36 while second output 32*c* communicates directly with heat exchanger 34 through conduit section 38. Three-way valve 32 may be selectively operated by control devices, such as a manually operated switch, an electrical timer, or a temperature sensor. In one particular arrangement, a temperature sensor 40 communicating with valve 32 is placed within interior volume 16 of basin 14 in direct contact with pool water 18. Preferably, temperature sensor 40 is placed near the upper surface of pool water 18 about one foot below water level where the temperature of pool water 18 may be the highest when the ambient air temperature is hot, such as at 90° F. (32° C.), or above.

Valve 32 may be controlled to operate in two modes in response from an electronic signal from temperature sensor 40 based on a predetermined temperature of pool water 18. For example, when the temperature of pool water 18 is below a predetermined temperature of about 80° F. (27° C.), or other selected temperature, an electronic signal from temperature sensor 40 would allow pool water 18 exiting filtering system 22 to flow from valve input 32*a* through first output 32*b* and into said interior volume 16 while preventing water 18 from flowing through second output 32*c* into heat exchanger 34. On the other hand, when the temperature of pool water 18 is at or above the predetermined temperature of about 80° F. (27° C.), an electronic signal from temperature sensor 40 would allow pool water 18 exiting filtering system 22 to flow from valve input 32*a* through second output 32*c* into heat exchanger 34 while preventing pool water 18 from flowing through first output 32*b* into interior volume 16 of pool 10.

Figure 2:
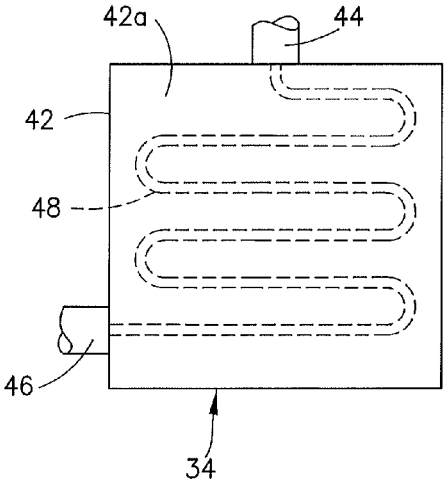
FIG. 2 is one embodiment of the heat exchanger encircled in FIG. 1.

Still referring to FIG. 1 and also now to FIG. 2, further details of heat exchanger 34 are described. Heat exchanger 34 in the arrangement shown in FIG. 2 comprises a block 42 formed of material having good thermal conductivity. Block 42 includes an input line 44, an output line 46 and a passageway 48 for circulating pool water 18 therethrough from input line 44 to output line 46. Input line 44 is coupled to second output 32*c* of valve 32 through conduit section 38. Output line 46 is coupled to conduit section 50 which is in communication with interior volume 16 for returning pool water 18 directly to interior volume 16 after circulating through heat exchanger 34. Passageway 48 may be formed as a continuous channel of serpentine loops so as to provide a desired distance for pool water 18 to flow while circulating through heat exchanger 34. The number of loops may be formed to provide the desired temperature drop of pool water 18 entering input line 44 and exiting output line 46. Channels defining passageway 48 may be circular, rectangular or any other suitable cross-section for desired flow of pool water 18 therethrough. Pool water 18 circulating through passageway 48 is in direct conductive contact with the walls of block 42 defining passageway 48 so that heat may be effectively conductively transferred from circulating pool water 18 through block 42 to the heat sink of ground 12.

Heat exchanger block 42 may be formed of two separate halves to facilitate the formation of channels defining passageway 48 therein, with such halves being then suitably joined with known fastening techniques to form a single block. In one configuration, block 42 has an outer configuration that is generally rectangular or square, it being understood that any desired configuration may be contemplated. Whatever the chosen configuration, the outer surfaces 42*a* of block 42 define an outer contact surface for being placed in direct contact with ground 12, as will be described.

In accordance with the invention, exchanger 34 is buried into the ground 12 at a depth D, as shown in FIG. 1, at which the ground temperature is substantially constant year-round, thereby defining a passive heat sink surrounding heat exchanger 34. As such, and as noted hereinabove, the depth D at which heat exchanger 34 is located is no less than about four feet and at least five feet below ground level. At such depth D the ground temperature, depending upon location, is in the range of approximately 55° F.-65° F. (approximately 13° C.-18° C.). Upon installation, contact surface 42*a* of heat exchanger block 42 is placed in direct contact with surrounding ground 12.

Conductive block 42 is selected, in accordance with the invention and as described herein, to be made of a material having good thermal conductivity. The term "good thermal conductivity" as used herein is meant to define a material having a thermal conductivity of at least about 20 W/mK, which is about the thermal conductivity of stainless steel. In a preferred arrangement, the material of block 42 is selected to have a "high thermal conductivity" which as used herein is meant to define a thermal conductivity of at least about 100 W/mK, which is about the thermal conductivity of brass. Such materials include, for example, aluminum having a thermal conductivity of about 205 W/mK, or more preferably copper, which has a thermal conductivity of about 401 W/mK. Copper is also desirable for its corrosion resistance and efficient heat absorption qualities. Variations of these metals, including copper alloys, are also desirable.

Figure 3:
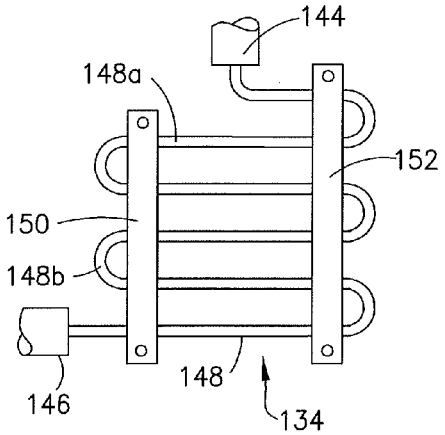
FIG. 3 is an alternative embodiment of the heat exchanger of FIG. 2

In an alternative arrangement, a heat exchanger 134 as illustrated in FIG. 3 may be used as an apparatus for cooling the temperature of pool water 18. Heat exchanger 134 comprises an input line 144, and output line 146 and a pipe 148 extending between input line 144 and output line 146, preferably in a configuration defining a continuous path of serpentine loops similar to heat exchanger 34. Input line 144 may be coupled to conduit section 38 while output line 146 may be coupled to conduit section 50. The interior opening of pipe 148 defines a passageway through which circulating water 18 is pumped from input line 144 to output line 146. Pipe 148 may be formed of a material having good thermal conductivity, or more preferably high thermal conductivity, such as copper. Pipe 148 may be constructed to have a relatively thin wall 148*a* so as to reduce the thermal resistance between the interior opening of pipe 148 and ground 12 thereby enhancing heat transfer from water 18 passing through pipe 148 to ground 12. For structural stability, pipe 148 may be secured by brackets 150 and 152, as illustrated in FIG. 3. The outer surface 148*b* of pipe 148 defines a contact surface that is placed in direct contact with ground 12 upon installation.

In use, heat exchanger 34 or 134 will only become operational when valve 32 is turned on manually by a switch, by an electrical timer or by the control of temperature sensor 40. When temperature sensor 40 is used, a predetermined temperature such as 80° F. (27° C.) may be programmed to operate valve 32 based upon an electronic signal from temperature sensor 40 that would function in a manner similar to a house thermostat. As such, when the temperature of pool water 18 is below 80° F. (27° C.), pool water 18 pumped from filtering system 22 would pass through first output 32*b* of valve 32 and through conduit section 36 into interior volume 16 with second output 32*c* of valve 32 being closed. When the temperature of pool water 18 reaches or exceeds 80° F. (27° C.) pool water 18 pumped from filtering system 22 would pass through second output 32*c* of valve 32 and through conduit section 38 to heat exchanger 34 or 134 with first output section 32*b* being closed. It may be desirable that pool water 18 entering input line 44 or 144 at a first temperature of 80° F. (27° C.) exit output line 46 or 146 a lower second temperature of, for example, 70° F. (21° C.), so that pool water 18 entering interior volume 16 would cause pool water 18 in interior volume 16 to decrease.

The design of heat exchanger 34 or 134, including its size and number of serpentine loops may be determined from several known factors. For example, it may be desired to cool pool water 18 circulating through heat exchanger 34 or 144 by 10° F. (6° C.), i.e., from an input temperature of 80° F. (27° C.) to an output temperature of 70° F. (21° C.). With the surrounding ground 12 providing a heat sink at a constant temperature of approximately 55° F. (13° C.), and with the flow rate of the filtering system pump 24 in gallons/minute and the specific heat of pool water 18 being known, the distance that pool water 18 must flow through the heat exchanger passageway at a given cross-sectional area may be determined by using conventional heat transfer and fluid flow analysis. Adjustments may be made to any of the variable factors in the analysis to achieve the desired drop in water temperature. It should also be understood that the pool water 18 temperatures described herein are only illustrative and that other water temperatures and temperature differentials for cooling may also be considered.

Having described the particular arrangement of the apparatus and method for cooling water 18 in a swimming pool 10, it should be appreciated that variations may be made thereto without deviating from the contemplated scope of the invention. For example, it should be appreciated that heat exchanger 34 or 134 is a passive device requiring no electrical energy or fans for operation other than the energy for pumping water 18 therethrough from pump 24. Furthermore, the passive heat exchanger 34 or 134 requires no evaporative processes, refrigeration units or refrigerants such as Freon. As such, use of heat exchanger 34 or 134 is environmentally desirable. To further enhance the environmental aspects of the invention, a solar panel 52, as depicted in FIG. 1 may be electrically coupled to filtering system 22 in a manner to provide suitable electricity to operate filtering system 22 and pump 24. In addition, while a single heat exchanger 34 or 134 has been described in communication with return conduit 30, it should be understood that more than one heat exchanger 34 or 134 may be coupled in tandem depending upon the amount of water to be cooled and/or the desired decrease in pool water temperature entering and exiting a heat exchanger 34 or 134. Further, while the particular pool cooling apparatus has been described in the context of an inground pool, it should be appreciated that the inventive concepts described herein may also be used with above ground pools. Lastly, while the invention has been described herein in the context of a newly installed inground pool, it should also be understood that the cooling apparatus may be used as a retrofit for previously installed pools.

Figure 4:
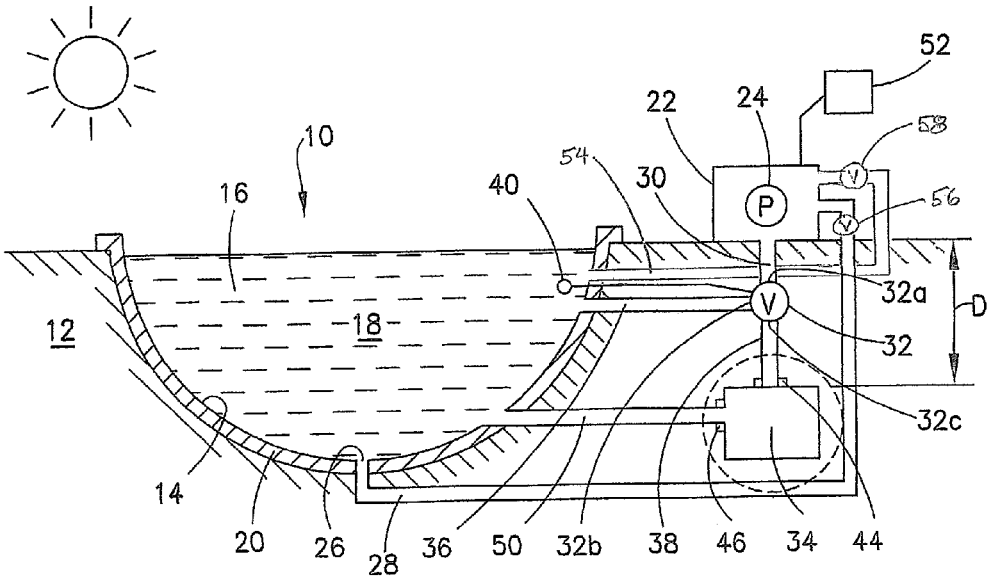
FIG. 4 is an alternative embodiment of the swimming pool of FIG. 1, including a skimmer conduit in communication with the pool filtering system.

Turning now to FIG. 4, a variation of the inground swimming pool 10 of FIG. 1 is shown with the addition of a skimmer conduit 54. As noted above, surface skimmers may be placed at the surface level of pool water 18 in communication with withdrawal conduit 28. In this variation of the swimming pool 10, skimmer conduit 54 is placed at or near the surface of pool water 18, which may be about a foot or less from the surface, in communication with filtering system 22, and may be operated independently of withdrawal conduit 28. In a particular arrangement, skimmer conduit 54 communicates with interior volume 16 through the wall of basin 14 at a location vertically above the location where conduit section 50, which communicates with heat exchanger output line 46, communicates with interior volume 16. Withdrawal conduit 28, which communicates with drain 26, is located at or near the bottom of pool basin 14 and below conduit section 50.

A two-way valve 56 is placed in communication with withdrawal conduit 28 and a two-way valve 58 is placed in communication with skimmer conduit 54. Each two-way valve 56 and 58 is capable of being selectively operated to open and thereby pass pool water 18 therethrough or to close and thereby prevent flow of pool water 18 therethrough. Each valve 56 and 58 is separately operable by a control device, such as a manually operated switch or knob, an electrical timer or a temperature sensor. It should be appreciated, however, that withdrawal conduit 28 and skimmer conduit 54 may also be coupled to a three-way valve, similar to valve 32 described above, where pool water 18 may be directed from withdrawal conduit 28 and skimmer conduit 54 together into filtering system 22 or from either withdrawal conduit 28 or skimmer conduit 54, individually.

In conjunction with heat exchanger 34, modified swimming pool 10 may be operated as follows. In a normal mode of operation, for example, where the temperature of pool water 18 is below the desired predetermined temperature of about 80° F. (27° C.) or other desired temperature, valve 32 would operate in response to an electronic signal from temperature sensor 40, to direct pool water 18 into interior volume 16 through conduit section 36, as described above, while preventing water 18 from entering into heat exchanger 34. In this normal mode of operation, both valves 56 and 58 may be opened such that pool water 18 from near the top and bottom of pool 10 may flow through the filtering system 22. In this normal mode of operation no cooling of pool water takes place.

If the temperature of the pool water 18 rises to or above the desired predetermined temperature, then in response to a signal from temperature sensor 40, valve 32 would operate as described above to direct pool water 18 into heat exchanger 34 while preventing flow of pool water 18 into interior volume 16 through conduit section 36. Water cooled by heat exchanger 34 in this regular cooling mode would flow into interior volume 16 through conduit 50 after being cooled. In this situation, both valves 56 and 58 may remain open, as in the normal mode of operation.

In the event however, that pool water 18 is not cooling sufficiently fast, or rises to or above a second predetermined temperature, for example about 84° F. (29° C.), a faster cooling mode may be employed. In the faster cooling mode, valve 32 would continue to allow flow of pool water 18 through heat exchanger 34 while preventing flow of pool water 18 through conduit section 36 into interior volume 16. Valve 56 in the withdrawal conduit 28 may be closed while valve 58 in the skimmer conduit 54 may be opened. This would prevent water from flowing from the bottom of the pool to filtering system 22 while allowing more pool water 18 closer to the surface of the pool 10 to flow through heat exchanger 34. Pool water that is near the surface would tend to be warmer than at the bottom of the pool 10 as such higher level water is more directly exposed to the sun. As such, by selectively allowing only that portion of the pool water near the surface to flow through skimmer conduit 54 and through heat exchanger 34, faster cooling of the upper portion of the pool water may be achieved. As cooled water exiting heat exchanger 34 enters interior volume 16 through conduit section 50, which is located below skimmer conduit 54 and above withdrawal conduit 28, such cooled water would be drawn upwardly by the suction of pump 24 through skimmer conduit 54, enhancing the faster cooling process.

In a particular arrangement of the faster cooling mode, valves 56 and 58 are coupled to temperature sensor 40 and are selected to operate in response to an electrical signal from sensor 40. Valves 56 and 58 may be set to operate in response to an electronic signal produced by temperature sensor 40 at the second predetermined temperature, i.e., about 84° F. (29° C.). As such, when pool water 18 is at or above the second predetermined temperature, valve 56 in the withdrawal conduit 28 would be closed thereby preventing pool water 18 to flow into filtering system 22 from the bottom of the interior volume 16. Valve 58 in the skimmer conduit 54 would be opened thereby allowing pool water 18 to flow into filtering system 22 and then through heat exchanger 34. In one approach valve 58 would open substantially simultaneously with the closing of valve 56. It should be understood that valves 56 and 58 may also be programmed to operate electronically in response to a signal from sensor 40 in the normal mode of operation of pool 10 as well as in the regular cooling mode, as described above.

It should therefore be appreciated that by selectively controlling the flow of pool water 18 through withdrawal conduit 28 and skimmer conduit 54 in conjunction with the flow of pool water 18 through heat exchanger 34, a portion of the pool water 18, such as the upper portion that is more directly exposed to the sun, may be selectively cooled in a manner to maintain comfortable swimming temperature levels. It should also be appreciated that heat exchanger 134 may also be used in the modified version of swimming pool 10. Accordingly, the various arrangements described herein are intended to be illustrative and not limiting.

What is claimed is:

1. In combination with a swimming pool of the type including a basin defining an interior volume for holding pool water, a filtering system including a pump for circulating water to and from said interior volume, a withdrawal conduit communicating with said interior volume through which water from said interior volume is drawn by said pump to said filtering system, a skimmer conduit communicating with said interior volume through which water is drawn by said pump to said filtering system, said skimmer conduit being located near the surface of said pool water, and a return conduit communicating with said interior volume through which filtered water is returned by said pump from said filtering system to said interior volume, an apparatus for cooling water from said interior volume comprising:

a passive heat exchanger, said heat exchanger being buried in the ground at a depth at which the ground temperature is substantially constant year-round thereby defining a heat sink surrounding said heat exchanger, said heat exchanger including an input line for receiving pool water at a first temperature from said filtering system and an output line in fluid communication with said interior volume for delivering pool water cooled by said heat exchanger through said basin and into said interior volume at a second temperature cooler than said first temperature, said output line being located below said skimmer conduit, said withdrawal conduit being located below said output line, said heat exchanger including a contact surface in direct contact with said heat sink and being formed of a material having good thermal conductivity to transfer and dissipate heat from said water circulating through said heat exchanger to said ground heat sink to thereby cool said water from said first temperature to said second temperature; and a first valve communicating with said return conduit and said input line and operative to selectively direct pool water from said filtering system directly to said interior volume of said basin or to said heat exchanger;

a second valve communicating with said withdrawal conduit and operative to selectively open or close to thereby allow or prevent flow of pool water through said withdrawal conduit to said filtering system; and a third valve communicating with said skimmer conduit and operative to selectively open or close to thereby allow or prevent flow of pool water through said skimmer conduit to said filtering system.

2. The apparatus of claim 1, further comprising a control device coupled to each of said first valve, said second valve and said third valve to control the respective operation of said valves.

3. The apparatus of claim 2, wherein each said control device is selected from the group of control devices consisting of manually operated switches, electrical timers, and temperature sensors.

4. The apparatus of claim 3, wherein said control device coupled to said first valve is a temperature sensor disposed within said interior volume of said basin in communication with said pool water to control the operation of said first valve at a predetermined temperature.

5. The apparatus of claim 4, wherein said first valve is a three way valve having a first output and a second output, said first output being in direct communication with said interior volume of said basin and said second output being in direct communication with said input line of said heat exchanger.

6. The apparatus of claim 5, wherein said first valve is operable when said water temperature is below said predetermined temperature to allow water exiting said filtering system to flow through said first output into said interior volume while preventing water from flowing through said second output into said heat exchanger.

7. The apparatus of claim 6, wherein said first valve is operable when said water temperature is at or above said predetermined temperature to allow water exiting said filtering system to flow through said second output into said heat exchanger while preventing water from flowing through said first output into said interior volume.

8. The apparatus of claim 7, wherein said second valve and said third valve are coupled to said temperature sensor, each of said second valve and said third valve being responsive to an electronic signal produced by said sensor at a second predetermined temperature to control the operation of said second and third valves.

9. The apparatus of claim 8, wherein said second valve is operable to close when said pool water temperature is at or above said second predetermined temperature thereby preventing flow of pool water through said withdrawal conduit to said filtering system, and wherein said third valve is operable substantially simultaneously with said operation of said second valve to open when said pool water temperature is at or above said second predetermined temperature thereby allowing flow of pool water through said skimmer conduit to said filtering system.

10. The apparatus of claim 7, wherein said heat exchanger comprises a block of material having high thermal conductivity, said block having a passageway for circulating pool water therethrough from said input line to said output line, the outer surfaces of said block defining said contact surface, said passageway being defined by a channel formed through said block and extending from said input line to said output line in a configuration of serpentine loops.

11. The apparatus of claim 7, wherein said heat exchanger comprises a pipe of material having high thermal conductivity, said pipe having a passageway for circulating pool water therethrough from said input line to said output line, the outer surface of said pipe defining said contact surface, said pipe being arranged in a configuration of serpentine loops from said input line to said output line.

12. The apparatus of claim 1, wherein said apparatus further comprises a solar panel communicating electrically with said filtering system to provide electricity to said filtering system and said pump.

13. A method of cooling water in a swimming pool, said swimming pool being of the type including a basin defining an interior volume for holding pool water, a filtering system including a pump for circulating water to and from said interior volume, a withdrawal conduit communicating with said interior volume through which water from said interior volume is drawn by said pump to said filtering system, a skimmer conduit communicating with said interior volume through which water is drawn by said pump to said filtering system, said skimmer conduit being located near the surface of said pool water, and a return conduit communicating with said interior volume through which filtered water is returned by said pump to said interior volume, said method comprising the steps of:

burying a passive heat exchanger in the ground at a depth at which the ground temperature is substantially constant year-round, thereby defining a heat sink surrounding said heat exchanger, said heat exchanger including an input line for receiving pool water from said interior volume, an output line for delivering pool water to said interior volume and a passageway from said input line to said output line for circulating pool water therethrough, said passageway being defined by a material having high thermal conductivity, said pool water circulating through said passageway being in conductive contact with said ground heat sink through said material such that heat is transferred and dissipated from said water to said ground heat sink during circulation;

coupling said input line of said heat exchanger to be in fluid communication with said return conduit of said swimming pool;

coupling said output line of said heat exchanger to be in fluid communication with said interior volume of said swimming pool;

placing a first valve in communication with said return conduit to selectively direct water from said return conduit directly to said interior volume of said basin or directly to said input line of said heat exchanger; and operating said pump to circulate pool water drawn from said interior volume through at least one of said withdrawal conduit and said skimmer conduit, through said filtering system and underground as a liquid through said heat exchanger when said first valve is operated to selectively direct pool water to said input line of said heat exchanger, said pool water being received through said input line at a first temperature and returned into said interior volume through said output line at a second temperature lower than said first temperature.

14. The method of claim 13, further including the steps of:

placing a second valve in communication with said withdrawal conduit operative to selectively open or close to thereby allow or prevent flow of pool water through said withdrawal conduit to said filtering system;

placing a third valve in communication with said skimmer conduit operative to selectively open or close to thereby allow or prevent flow of pool water through said skimmer conduit to said filtering system;

operating said second and third valves to selectively open at least one of said second or third valves to allow pool water from said interior volume to flow to said filtering system; and operating said first valve to selectively direct pool water from said filtering system directly to said input line of said heat exchanger while preventing flow of pool water from said filtering system to said interior volume.

15. The method of claim 14, wherein said second and third valves are operated to selectively open to allow pool water from said interior volume to flow to said filtering system through both said withdrawal conduit and said skimmer conduit.

16. The method of claim 14, wherein said second valve is operated to close thereby preventing flow of pool water from said interior volume through said withdrawal conduit to said filtering system, and wherein said third valve is operated to open thereby allowing pool water from said interior volume to flow through said skimmer conduit to said filtering system.

17. The method of claim 16, further including the step of placing a temperature sensor in said pool water near the surface of said pool water for producing an electronic signal to control the mode of operation of said first valve in response to a predetermined temperature of said pool water, coupling said sensor to said first valve, said first valve being responsive to said electronic signal to allow pool water to enter said input line of said heat exchanger while preventing pool water to directly enter said interior volume.

18. The method of claim 17, further including the steps of coupling said temperature sensor to said second valve and said third valve to control the mode of operation of said second and third valves, wherein said second valve is responsive to an electronic signal from said sensor to close when said pool water temperature is at or above a second predetermined temperature thereby preventing flow of pool water through said withdrawal conduit to said filtering system, and wherein said third valve is responsive to said electronic signal to open substantially simultaneously with the closing of said second valve when said pool water temperature is at or above said second predetermined temperature thereby allowing flow of pool water through said skimmer conduit to said filtering system.

19. A method of cooling water in a swimming pool, said swimming pool being of the type including a basin defining an interior volume for holding pool water, a filtering system including a pump for circulating water to and from said interior volume, said method comprising the steps of:

burying a passive heat exchanger in the ground at a depth at which the ground temperature is substantially constant year-round, thereby defining a heat sink surrounding said heat exchanger, said heat exchanger including an input line for receiving pool water from said interior volume, an output line for delivering pool water to said interior volume and a passageway from said input line to said output line for circulating pool water therethrough, said passageway being defined by a material having good thermal conductivity, said pool water circulating through said passageway being in conductive contact with said ground heat sink through said material such that heat is transferred and dissipated from said water to said ground heat sink during circulation; and directing pool water from one portion of said interior volume selectively to said input line of said heat exchanger while preventing pool water from another portion of said interior volume from entering said input line.

20. The method of claim 19, wherein said swimming pool includes a withdrawal conduit communicating with said interior volume near the bottom of said basin, and a skimmer conduit communicating with said interior volume near the surface of said pool water, and wherein pool water through said conduit skimmer is selectively directed to said input line of said heat exchanger while pool water through said withdrawal conduit is selectively prevented from entering said input line.

* * * * *